US009134065B2

(12) United States Patent
Hoffman-Lubitch

(10) Patent No.: US 9,134,065 B2
(45) Date of Patent: Sep. 15, 2015

(54) KITCHEN UTENSIL DRYER

(76) Inventor: Dvorah Hoffman-Lubitch, Tel Aviv (IL)

( * ) Notice: Subject to any disclaimer, the term of this patent is extended or adjusted under 35 U.S.C. 154(b) by 0 days.

(21) Appl. No.: 13/400,134

(22) Filed: Feb. 20, 2012

(65) Prior Publication Data

US 2012/0144688 A1 Jun. 14, 2012

Related U.S. Application Data

(63) Continuation of application No. 12/222,306, filed on Aug. 6, 2008, now abandoned.

(60) Provisional application No. 60/963,688, filed on Aug. 7, 2007.

(51) Int. Cl.

| | |
|---|---|
| ***F26B 19/00*** | (2006.01) |
| ***F26B 5/16*** | (2006.01) |
| ***F26B 1/00*** | (2006.01) |
| ***A47L 19/00*** | (2006.01) |

(52) U.S. Cl.

CPC . *F26B 5/16* (2013.01); *A47L 19/00* (2013.01); *F26B 1/00* (2013.01)

(58) Field of Classification Search

CPC ..... F26B 5/16; F26B 1/00; A47L 19/00
USPC ..... 15/215, 217; 34/95, 105; 248/346.11; 211/41.3, 41.4, 41.5, 41.6, 41.8, 41.9, 211/85.25

See application file for complete search history.

(56) References Cited

U.S. PATENT DOCUMENTS

| | | | | |
|---|---|---|---|---|
| 3,195,847 | A * | 7/1965 | Squires | 248/346.11 |
| 4,124,116 | A * | 11/1978 | McCabe, Jr. | 96/108 |
| 4,338,366 | A * | 7/1982 | Evans et al. | 428/76 |
| 4,381,611 | A * | 5/1983 | Wishman | 34/339 |
| 5,428,857 | A * | 7/1995 | Murray | 15/217 |
| 5,650,016 | A * | 7/1997 | Jones | 134/6 |
| 5,679,399 | A * | 10/1997 | Shlenker et al. | 427/2.3 |
| 5,885,524 | A * | 3/1999 | Watanabe et al. | 422/40 |
| 5,911,848 | A * | 6/1999 | Haber et al. | 156/245 |
| 5,978,566 | A * | 11/1999 | Plank et al. | 709/206 |
| 6,081,927 | A * | 7/2000 | Gimbel | 2/161.7 |
| 6,395,656 | B1 * | 5/2002 | Jin et al. | 442/159 |
| 6,516,956 | B2 * | 2/2003 | Martorella et al. | 211/41.6 |
| 6,709,728 | B2 * | 3/2004 | Kerr et al. | 428/47 |
| 6,846,545 | B2 * | 1/2005 | Thomas | 428/85 |
| 7,484,261 | B2 * | 2/2009 | Sigl et al. | 15/104.94 |
| 7,895,768 | B2 * | 3/2011 | Vossoughi et al. | 34/60 |
| 2002/0053572 | A1 * | 5/2002 | Nordvik | 220/555 |
| 2003/0138579 | A1 * | 7/2003 | Savoca et al. | 428/36.8 |
| 2003/0141204 | A1 * | 7/2003 | Yuskaitis | 206/223 |
| 2003/0162684 | A1 * | 8/2003 | Huyhn et al. | 510/438 |
| 2004/0121905 | A1 * | 6/2004 | Ranganathan et al. | 502/402 |
| 2005/0266221 | A1 * | 12/2005 | Karam et al. | 428/292.1 |
| 2006/0032075 | A1 * | 2/2006 | Vossoughi et al. | 34/95 |
| 2007/0192932 | A1 * | 8/2007 | Wells | 2/162 |
| 2008/0178366 | A1 * | 7/2008 | Daher | 2/161.6 |
| 2008/0263738 | A1 * | 10/2008 | Shamis et al. | 2/16 |
| 2008/0280086 | A1 * | 11/2008 | Sheridan et al. | 428/40.7 |
| 2008/0302927 | A1 * | 12/2008 | Tredinnick | 248/176.1 |

* cited by examiner

*Primary Examiner* — Monica Carter
*Assistant Examiner* — Michael Jennings
(74) *Attorney, Agent, or Firm* — Dekel Patent Ltd.; David Klein

(57) ABSTRACT

A multi layered kitchen utensil dryer is provided comprising at least one layer of porous absorbent material enveloped by at least one sheet material, said sheet material being secured to the absorbent material.

11 Claims, 4 Drawing Sheets

KITCHEN UTENSIL DRYER

CROSS-REFERENCE TO RELATED APPLICATIONS

This application claims the benefit of prior U.S. provisional patent application No. 60/963,688, filed Aug. 7, 2008, and is a continuation of U.S. patent application Ser. No. 12/222,306, filed Aug. 6, 2009 now abandoned, the contents of which are hereby incorporated by reference in their entirety.

FIELD OF THE INVENTION

This invention relates to a pliable kitchen utensil dryer.

Hereinafter in specification and claims the term 'kitchen utensils' is used to denote any cutlery, crockery, cooking utensils and the like—it being obvious that the invention may be applied to other utensils which require drying.

BACKGROUND OF THE INVENTION

In order to dry kitchen utensils at a vicinity of a kitchen sink, it is common to place kitchen utensils over a regular kitchen towel for drying purposes. Such a kitchen towel typically comprises a single layer of a fabric material which is often a terry cloth or plain cotton. Such towels have a restricted liquid absorption capacity and are slow in drying. Even more so placing fine crockery utensils such as wine glasses over a single layered towel may result in breaking or chipping of the utensil. Placing wet dishes over the single layered fabric material often results in steam that accumulates in the utensils (in particular glasses and the like) placed over the material, as the steam and humidity do not evaporate. Such conditions may result in water stains on the utensils and may even cause development of mold and bacteria which may cause unpleasant smell and health hazard.

Various types of multilayered pliable articles are known in the art. Such articles are often directed to cleaning various surfaces, to wash surfaces and to retain various liquids.

U.S. Pat. No. 6,858,281 discloses a golf towel for retaining water over four hours. Such cloth comprises an outer layer of Terry cloth made of a composite texture of, including but not limited to, cotton, polyester and polyimide; an inner layer of porous hydrophilic polymer; and a grommet for a holding means. The layers are cut into a similar size and stitched together to prevent a separate moving.

EP0060076 describes a cleaning cloth which comprises a layer of foamed synthetic plastics material united with a piece of woven or knitted fabric. The foamed synthetic plastics material according to this patent can be sandwiched between two layers of fabric.

U.S. Pat. No. 3,162,964 relates to cleaning cloths employed for various household purposes and for similar uses and also to wash cloths for personal use.

SUMMARY OF THE INVENTION

The present invention is concerned with a multi layered kitchen utensil dryer comprising at least one layer of porous absorbent material enveloped by at least one sheet material, said sheet material being secured to the absorbent material.

The invention is further directed towards a multi layered kitchen utensils dryer comprising at least two layers of sheet material co-extensive in shape with an at least one layer of a porous absorbent material, wherein the at least one layer of the absorbent material is sandwiched between the at least two layers of sheet material and secured to one another at least around their common periphery to prevent separate moving.

Any one or more of the following features and characteristics may be implemented in a kitchen utensil dryer according to the present invention:

- the dryer may be capable of rapid large volume liquid absorption and vast evaporation;
- the sheet material may comprise a first layer corresponding with one face of the absorbent material, and a second layer corresponding with another face of the absorbent material, and wherein said first layer and said second layer may be made of same material or different material;
- at least one of the first layer and second layer of sheet material may be a fabric material;
- the fabric material may be Terry cloth;
- the fabric material may be microfiber;
- the fabric material may be mesh;
- the absorbent material may be enveloped by a single continuous layer of the sheet material;
- at least one of the sheet material and the absorbent material may be impregnated with at least one of an anti bacterial, anti microbial, anti fungi and anti mold agent;
- the absorbent material and the sheet material may be co-extensive;
- the layers may be secured at least around the edges thereof; and
- the layers may be secured together at least around their edges and in at least two intervaled longitudinal and traverse stitches on faces thereof.

BRIEF DESCRIPTION OF THE DRAWINGS

In order to understand the invention and to see how it may be carried out in practice, embodiments will now be described, by way of non-limiting examples only, with reference to the accompanying drawings, in which.

DETAILED DESCRIPTION OF EMBODIMENTS

In the following description the present invention will be described with reference to a kitchen utensil dryer.

Figure 1:
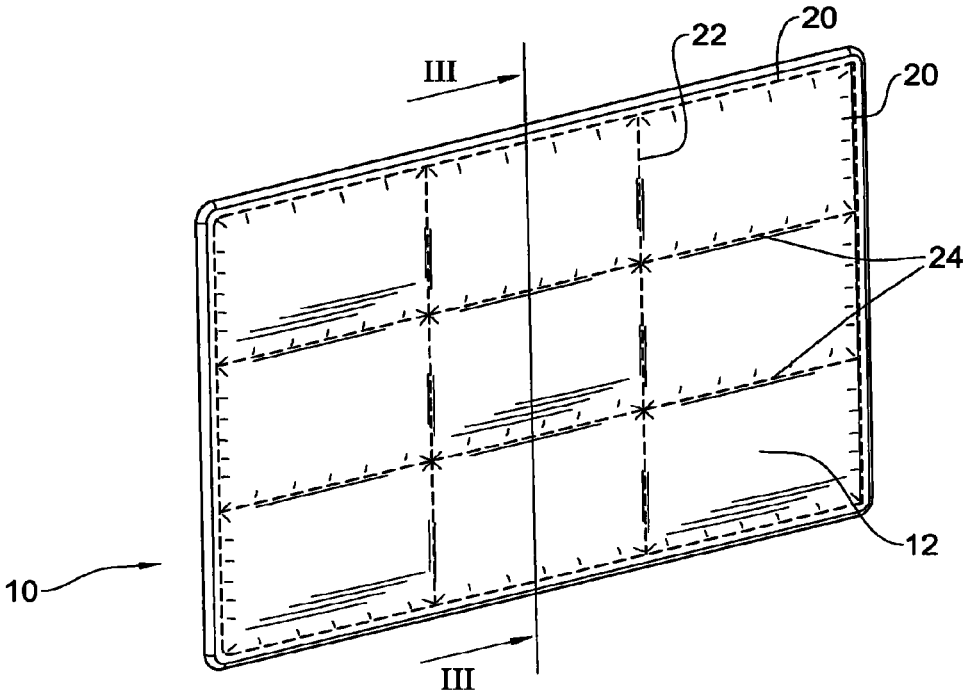
FIG. 1 is an isometric view of a kitchen utensil dryer according to an embodiment of the present invention.

In FIG. 1 a multilayered kitchen utensil dryer generally designated 10 is shown. The multilayered kitchen utensil dryer 10 is capable of rapid large volume liquid absorption and rapid liquid evaporation. The dryer 10 comprises according to an exemplified in FIG. 1 embodiment two layers of sheet material (only layer 12 seen in FIG. 1; see also FIGS. 2A and 2B) co-extensive in shape with at least one layer of porous absorbing material such as sponge 16 (not seen in FIG. 1).

The at least one layer of porous absorbent material 16 is sandwiched between the two layers of sheet material 12 and 14 and is secured to the same by stitches 20, at least around their common periphery, such that a separate movement of the sponge away from the layers 12 and 14 enveloping it is prevented. In addition to the stitches 20 around the common periphery, the layers of the dryer 10 are also secured in a warp 22 and weft 24 pattern. The warp stitch 22 and weft stitch 24 secure all the layers of the dryer 10 together in a fixed relationship and in an eye pleasing fashion.

The porous absorbent material 16 is such that when soaking wet, washed and dried, e.g. in a washing machine and dried in a dryer machine, the separate layers of the dryer will not shrink and will prevent the fabric layers from deformation of the dryer as typically happens with kitchen towels used for similar purposes.

Noting that the dryer is used extensively and in wet vicinity, it is often soaked with liquid, typically water, giving rise to generation of fungi, bacteria, mold and the like. In order to prevent this from happening the dryer, in addition to it's rapid liquid evaporation property, may optionally be impregnated with at least an anti bacterial agent, anti microbial and/or anti fungi (including micro fungi such as mold) agents.

Figure 2A:
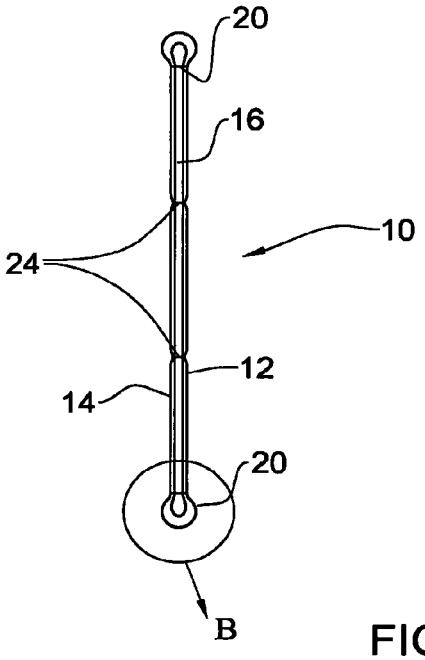
FIG. 2A is a section along III-III in FIG. 1.
Figure 2B:
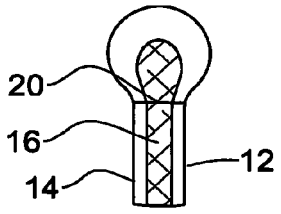
FIG. 2B is an enlargement of the portion marked B in FIG. 2A.

FIG. 2B is an enlargement of the portion marked B in FIG. 2A illustrating an edge of the dryer 10 and it shows the overlapping relation of the second layer 14 over the first layer 12 such that the stitch 20 secures the two layers 12 and 14 and the sponge 16 together in a fixed relation and in an eye-pleasing fashion. The pipe stitch includes all layers of the dryer and provides a reliable coupling arrangement which apart for being eye-pleasing also ensures that the dryer maintains its shape and that the different layers do not detach from one another, whilst not deteriorating the absorbing qualities of the dryer.

Figure 3:
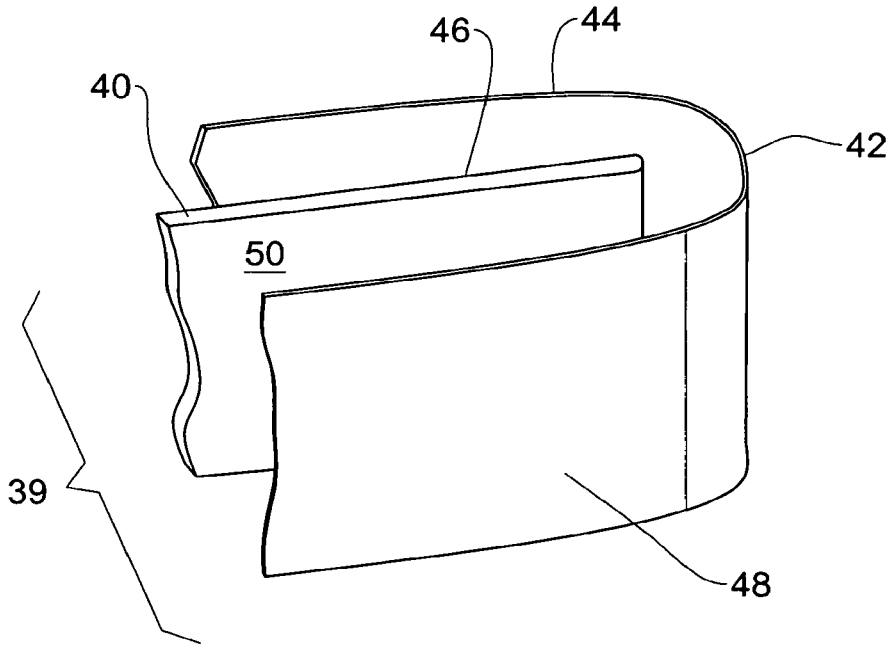
FIG. 3 is an exploded isometric view of the kitchen utensil dryer seen in FIG. 1.

Referring now to FIG. 3, an exploded view of an embodiment of a dryer 39 is shown, wherein the absorbent material 40 is enveloped by a single, continuous layer of sheet material 42, having a first layer 44 corresponding with a face 46 of the absorbent material 40, and a second layer 48 corresponding with a second face 50 of the absorbent material 40. Other features are substantially similar to the embodiment of FIG. 1.

Figure 5:
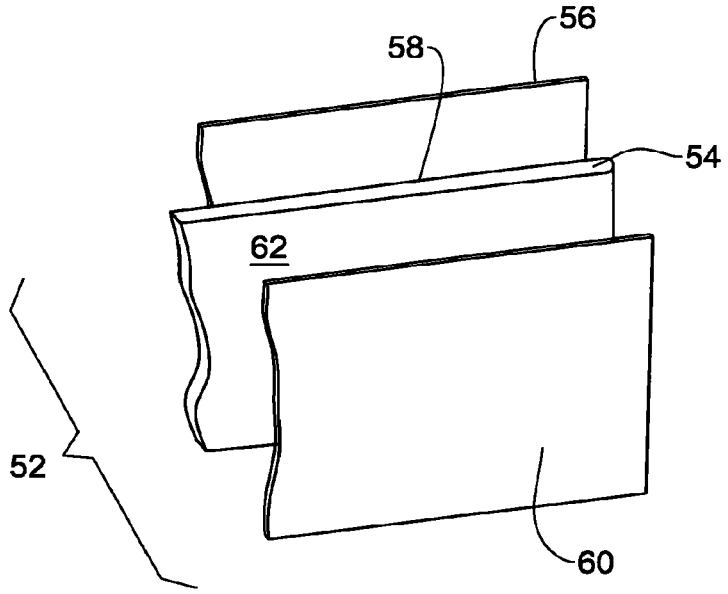
FIG. 5 is an exploded isometric view of the kitchen utensil dryer according to an embodiment of the invention.

The embodiment of FIG. 5 illustrates a dryer 52 wherein the absorbent material 54 is enveloped by two individual layers of sheet material, a first layer 56 corresponding with a face 58 of the absorbent material 54, and a second layer 60 corresponding with a second face 62 of the absorbent material 54.

According to any of the embodiments previously described, the porous absorbent material may be porous rubber, porous cellulose, a sponge and the like. The sheet layer enveloping the absorbent material may be a natural or synthetic fabric material such as Terry cloth, mesh, microfiber, regular cotton fabric and the like.

For example, one layer of a sheet material may be a terry cloth which assists in rapid absorption of liquid and the second layer of the sheet material may be a layer of flat cotton fabric or mesh material which is particularly useful for rapid evaporation of the liquid absorbed into the dryer.

Figure 6A:
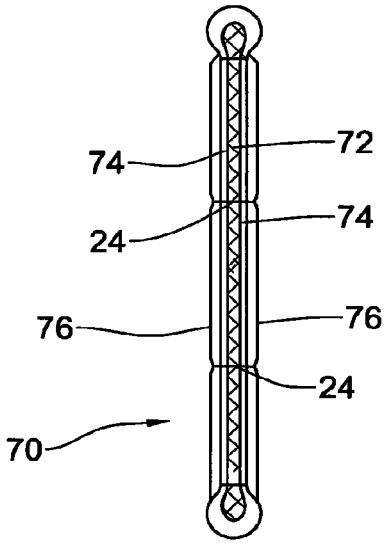
FIGS. 6A-6B is a sectional view of a kitchen utensil dryer according to another embodiment of the present invention

Turning now to FIG. 6A, a sectional view of a dryer 70 according to still an embodiment of the present invention is illustrated. According to this embodiment the two faces of the absorbent material 72 are each covered by two separate layers of sheet material 74 (inside layer) and 76 (outside layer). This embodiment is useful, for example, to increase stability and rigidity of the structure. For example the inside layer may be reinforced mesh material, and the outside layer may be any textile material as discussed herein.

Figure 6B:
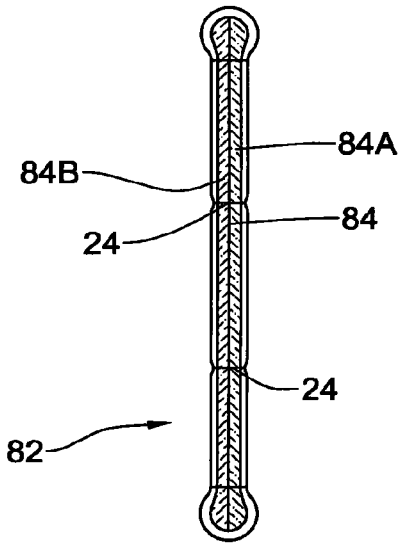

In the embodiment of FIG. 6B a section of a dryer 82 according to still an embodiment of the invention is illustrated. According to this embodiment the porous absorbent material 84 is composed of two co-planar layers 84A and 84B, each having different absorption capacity.

Figure 4:
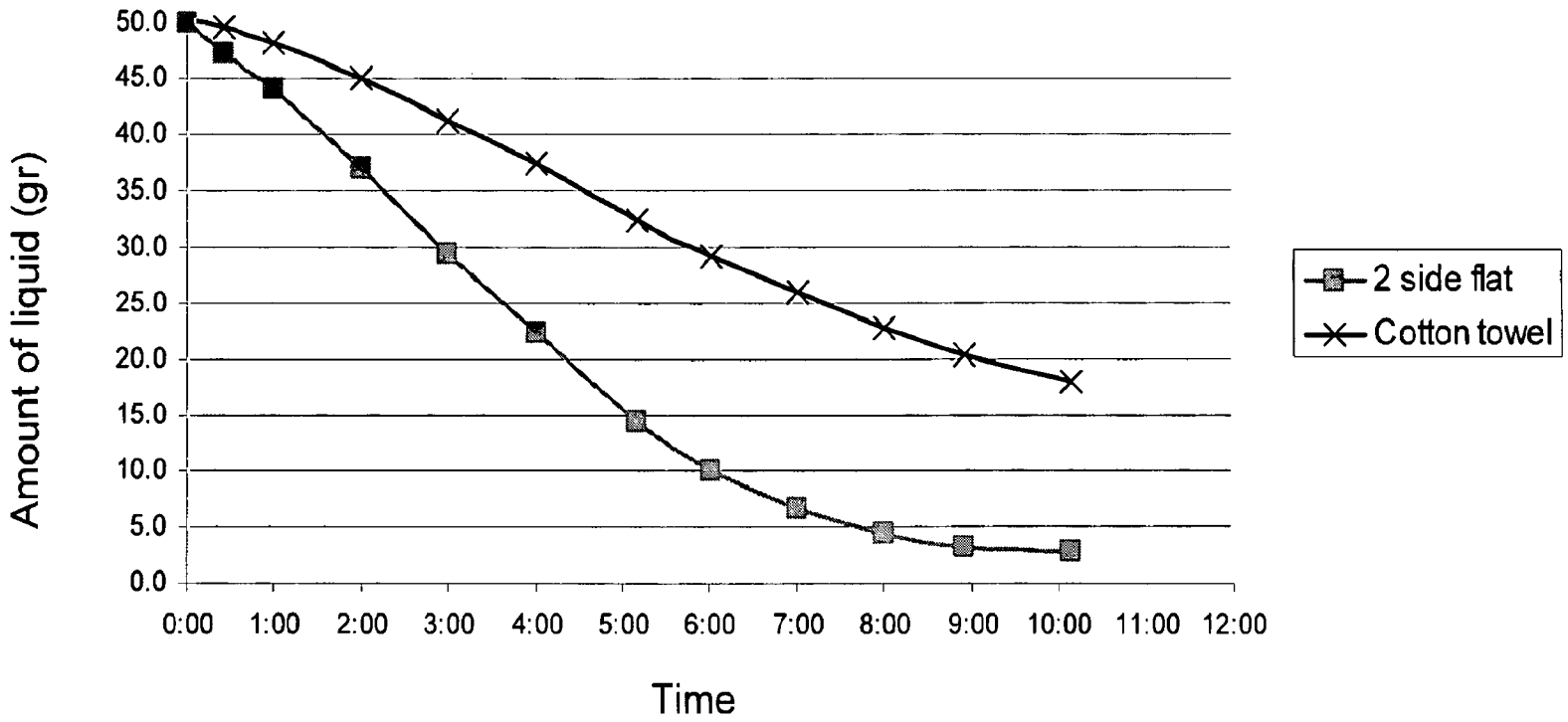
FIG. 4 is a diagram representing liquid evaporation rate over time, from a kitchen utensil dryer according to an embodiment of the present invention, and a typical kitchen towel.

In order to illustrate the features of the dryer, an experiment was performed using the dryer of the present invention and regular cotton kitchen towel. The following were the results of the experiments:

50 grams of water were instantaneously soaked into the dryer of the present invention and a typical cotton kitchen towel;

the diagram shown in FIG. 4 represents the rate and amount of the liquid evaporation over 10 hours at room temperature; I It can be seen that the rate of evaporation rate of water from the cotton kitchen towel is substantially slower than the rate of evaporation from a kitchen dryer according to the present invention.

Specifically, after 10 hours almost all liquid (>45 gr.) was evaporated from the kitchen utensil dryer according to the present invention while the cotton towel was left with almost 18 gr. of water soaked into it during the same period of time.

Those skilled in the art to which this invention pertains will readily appreciate that numerous changes, variations, and modifications can be made without departing from the scope of the invention, mutatis mutandis.

What is claimed is:

1. A method for drying kitchen utensils comprising:

placing a multi-layered dryer on a surface external to said multi-layered dryer, wherein said multi-layered dryer comprises at least one layer of porous absorbent material sandwiched between two layers of sheet material which are co-extensive in shape, said layers of sheet material being secured to said absorbent material and wherein said sheet material rapidly evaporates liquid absorbed into the dryer, and wherein said porous absorbent material comprises two co-planar layers, each made of a material with a different absorption capacity; and placing kitchen utensils upon said multi-layered dryer, while said dryer is supported upon said surface, said surface being external to said utensils, until said utensils have dried a desired amount.

2. The method according to claim 1, further comprising preventing mold forming on said multi-layered dryer by having at least one of said layers of sheet material and said absorbent material being impregnated with an anti-mold agent.

3. The method according to claim 1, further comprising preventing bacteria forming on said multi-layered dryer by having at least one of said layers of sheet material and said absorbent material being impregnated with an anti-bacterial agent.

4. The method according to claim 1, further comprising preventing microbes forming on said multi-layered dryer by having at least one of said layers of sheet material and said absorbent material being impregnated with an anti-microbial agent.

5. The method according to claim 1, further comprising preventing fungi forming on said multi-layered dryer by having at least one of said layers of sheet material and said absorbent material being impregnated with an anti-fungi agent.

6. The method according to claim 1, wherein said two layers comprise two separate co-planar layers.

7. The method according to claim 1, wherein after 10 hours about 95% of liquid absorbed by said multi-layered dryer has evaporated.

8. The method according to claim 1, comprising using porous absorbent material that is secured to said layers of sheet material by stitches at least around their periphery.

9. The method according to claim 1, wherein said surface is near a kitchen sink.

10. The method according to claim 1, wherein said kitchen utensils drip dry upon said multi-layered dryer.

11. The method according to claim 1, comprising using said sheet material to rapidly evaporate liquid absorbed into the dryer and to prevent the liquid from causing water stains, mold and bacteria on the utensils.

* * * * *